US006488282B1

(12) United States Patent
Portela

(10) Patent No.: US 6,488,282 B1
(45) Date of Patent: Dec. 3, 2002

(54) GAME OF CHANCE COMPRISING A CUP AND FIVE FLAT ROUND PIECES, ALL MARKED ON ONE SIDE WITH THE PLUS(+) SYMBOL AND WITH THE MINUS (–) SYMBOL ON THE OTHER SIDE

(76) Inventor: Maria Teresa Portela, 2496 SW. 17 Ave. #5112, Miami, FL (US) 33145

( * ) Notice: Subject to any disclaimer, the term of this patent is extended or adjusted under 35 U.S.C. 154(b) by 0 days.

(21) Appl. No.: 09/844,725

(22) Filed: Apr. 30, 2001

(51) Int. Cl.[7] ..... A63B 71/00

(52) U.S. Cl. ..... 273/144 R; 273/145 A; 273/144 A; 273/146; 273/291

(58) Field of Search ..... 273/146, 272, 273/291, 290, 288, 144 A, 195 A, 145 A, 145 C

(56) References Cited

U.S. PATENT DOCUMENTS 2,131,653 A * 9/1938 Amsterdam ..... 273/272
2,979,230 A * 4/1961 Calverley ..... 273/144 A
3,232,621 A * 2/1966 Michelson ..... 273/144 A
4,629,194 A * 12/1986 Spero et al. ..... 273/236
4,893,816 A * 1/1990 Levy et al. ..... 273/146
5,116,062 A * 5/1992 Johnson ..... 273/260

* cited by examiner

*Primary Examiner*—Benjamin H. Layno

(57) ABSTRACT

A game of chance comprising a cup called a cube and five flat round pieces called "duds", which are marked Plus (+) on one side and Minus (–) on the other side. The cube should be preferably made with thick transparent material, to resemble a disposable plastic cup, and the duds with a material consistent in weight to that of a twenty-five cent coin (quarter) that will induce the piece to fall flat when tossed on a surface. The material, weight, size, may vary, as long as the changes do not affect the original idea for the operation of the game. This wagering system can be used as a game for two or more persons. It can be utilized for other games, board-games, and casino table games. It may be used for electronic games also. To play the game, a player inserts the five duds into the cube, covers the opening with one hand, shakes the cube, and then tosses the duds randomly on the playing surface. The symbols appearing face up on the five duds are summed up, and the result, either Plus or Minus, recorded, to be compared to the result of the opponent player or players. The highest score wins.

1 Claim, 2 Drawing Sheets

GAME OF CHANCE COMPRISING A CUP AND FIVE FLAT ROUND PIECES, ALL MARKED ON ONE SIDE WITH THE PLUS(+) SYMBOL AND WITH THE MINUS (–) SYMBOL ON THE OTHER SIDE

FEDERAL SPONSORED RESEARCH not applicable

SEQUENCE LISTING not applicable

BACKGROUND—FIELD OF INVENTION

This invention pertains to the extensive field of games and gambling. It can be used for children's games, for adult board games, and for many casino activities. Cube 'n Duds, as a game, by itself, can be played by two or more persons, and, due to its innovative wagering method, can be an instrument for many other games.

BACKGROUND—PRIOR ART

Dice and cards, as wagering systems, must be considered Prior Art. they are the prevalent systems used in all actual table games.

A search of the PTO files show 447 US patents using the betting systems of dice or cards.

Prior Art has failed to show a substitute system of wagering for children's board games.

A search of the PTO files shows 52 US patents for casino games using dice or cards as a wagering system.

Prior Art has failed to show a new constructive, educational betting system for children's games, for board games, and for casino games.

OBJECT AND ADVANTAGES

Cube 'n Duds is a system using Plus and Minus. It is easy to understand and the game induces the one who plays to think fast when adding or subtracting.

This invention is different from other wagering systems because the result of each play may be positive or negative. Other betting games produce add-on cumulative results, in which the numbers (cast, if by dice) (or dealt, if by cards) are to advance to win. With Cube 'n Duds, using Pluses and Minuses, you can advance to win or retrocede to lose.

The odds of this game are very different. When the player tosses the duds, the results can be:

1, 3, or 5 Plus 1, 3, or 5 Minus which figures can be the basis for innumerable other games, if to move on a board, or to bet at a casino table.

SUMMARY

Cube 'n Duds is an innovative wagering system comprising a cube and five pieces (duds) each. It is a competitive game that can be played by two or more. This patent application is for the invention of Cube 'n Duds only, the many different games that can be devised or evolved from this invention must be the subject of other applications.

The odds of this game are complicated and exciting. If a player tosses Five Pluses, it is the maximum winning deal. If the player tosses Five Minuses, he loses all. Since all duds are marked Plus on one side and Minus on the other, the number Four can never result. The failure to obtain a Minus 4 or a Plus 4, is the feature that affects the odds greatly.

DETAILED DESCRIPTION

Cube 'n Duds is a wagering game for two or more persons, using a cube, preferably made with transparent plastic material, and five round flat pieces (duds). These duds are all exactly alike, they may be the size of a US five-cent coin, and all are marked on one side with a Plus (+) sign, and on the other side with a Minus (–) sign.

DETAILED DESCRIPTION

Cube 'n Duds is a wagering game for two or more persons, using a cup called a cube, preferably made with transparent plastic material, and five round flat pieces called duds. These duds are all exactly alike, they may be the size of a US five-cent coin, and all are marked on one side with a Plus (+) sign, and on the other side with a Minus (–) sign.

Figure 1:
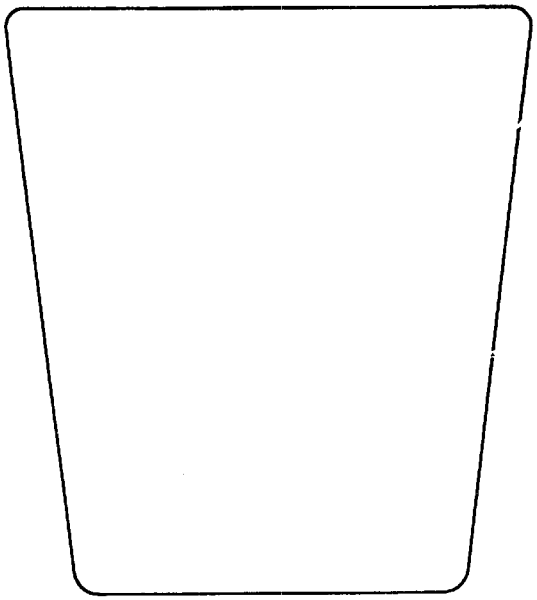
FIG. 1 is a front view of the cube (or cup)

FIG. 1, shows a front view of the cube resembling a disposable plastic cup of the kind generally used for fruit juices or for children.

Figure 2:
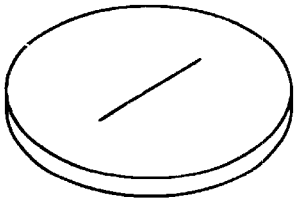
FIG. 2 is a view of one dud showing the side with the Minus (–) symbol face up
Figure 3:
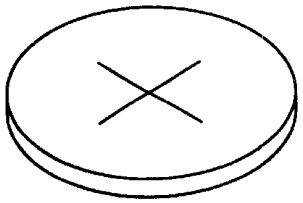
FIG. 3 is a view of one dud showing the side with the Plus (+) symbol face up
Figure 4:
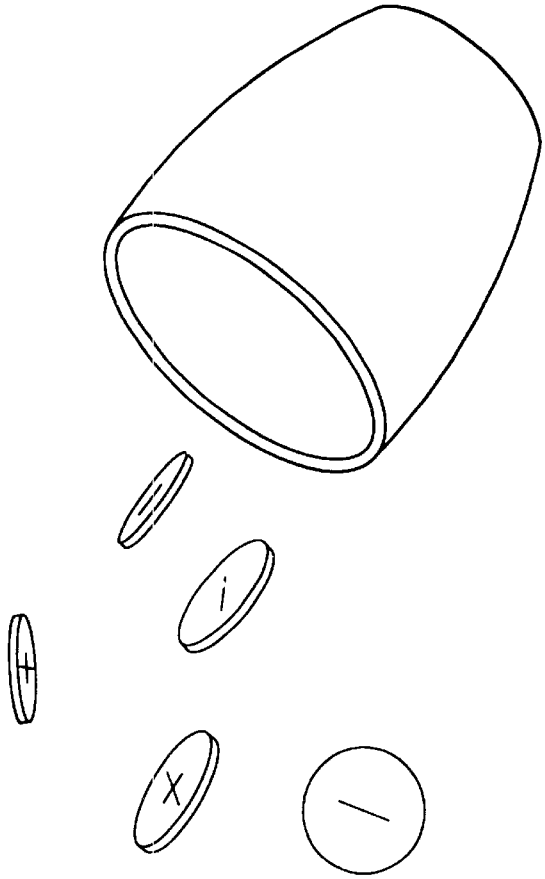
FIG. 4 is a view of the cube (or cup) tossing the duds onto a playing surface
Figure 5:
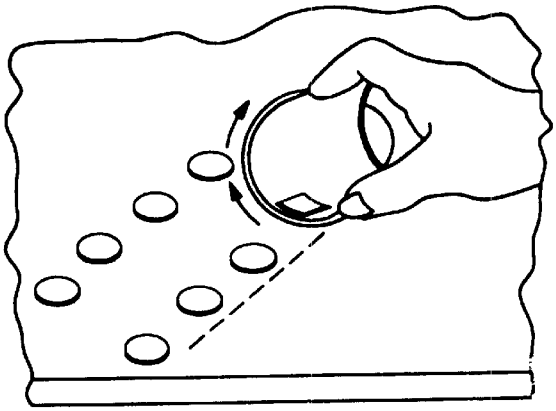
Fig. 5 Prior Art
FIG. 5 is Prior Art showing a dispensing cup and chips
Figure 6:
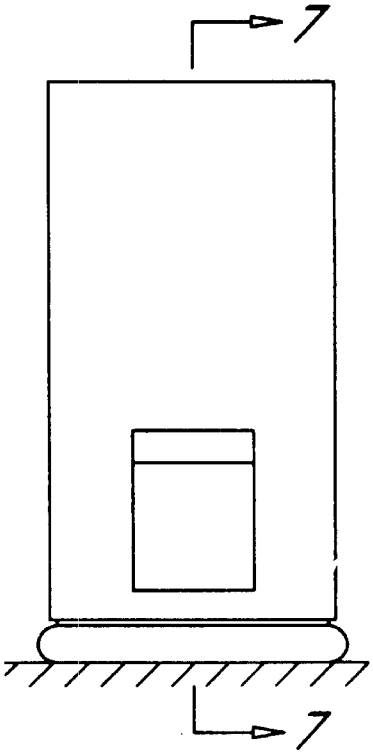
Fig. 6 Prior Art
FIG. 6 is Prior Art showing a partial view of the dispensing mechanism
Figure 7:
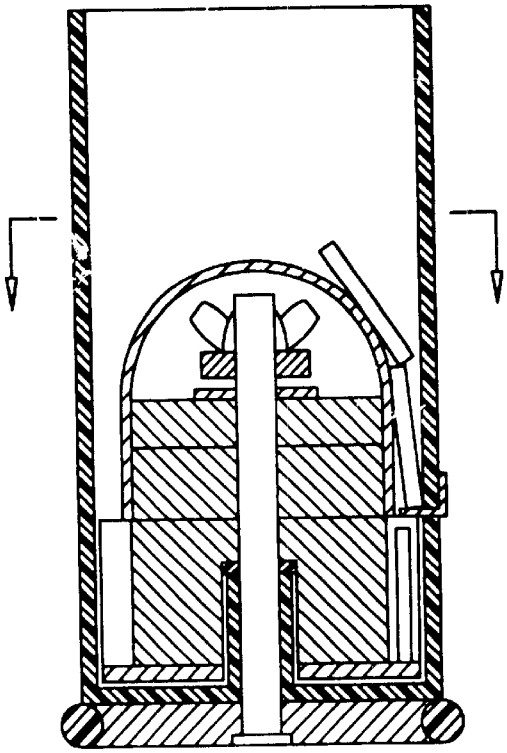
Fig. 7 Prior Art
FIG. 7 is Prior Art showing detailed interior view of the dispensing apparatus
Figure 8:
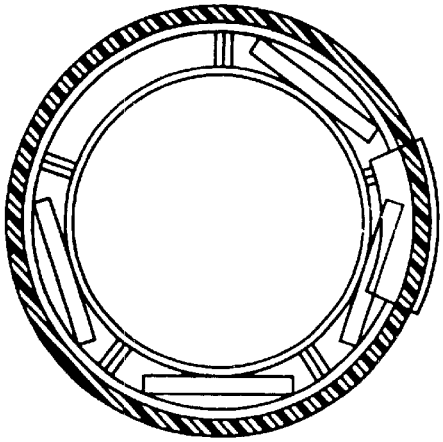
Fig. 8 Prior Art
FIG. 8 is Prior Art showing the interior viewed from below

FIG. 2 and FIG. 3 show flat round pieces called Duds with the symbols face up. The symbols on these duds are important in determining the progress and outcome of the game.

The materials used for manufacturing the cube and the duds is of no importance, as long as the cube is simple and not designed with any concealing properties, and the duds are of a size conforming to tossing and with marks easily discernible by all players. The weight of each dud is important to make it fall flat on the playing surface.

OPERATION

To start the game, a player takes the cube and places the duds inside, shakes it with one hand covering the opening, and then places the cube upside-down on the table, lifting it slowly for his opponent to see the result. All five pieces must lie flat, or the lot must be re-played. The symbols of Plus and Minus shown face-up on the duds are then summed up, meaning added and subtracted. If a player shows 3 Pluses and 2 Minuses, his result is Plus 1. If the player gets 1 Plus and 4 Minuses, his result is Minus 3. And so forth.

Cube 'n Duds can be played by two persons, or more, with the goal, or end of the game, set by the players. Here are examples of possible games to be played with Cube 'n Duds: (a) Four players set a goal of 50 for the game. If any one tosses 5 Minuses, he pays everyone else and is out of the game. If any one tosses 5 Pluses, everyone pays him. Or the 5 Minuses and 5 Pluses are simply recorded in the competition to reach the goal of 50. (b) For a casino table game six can sit playing against the dealer, just as in Black Jack or Poker. The toss of each player is matched against the dealer's, and the penalties and bonuses for Minus 5 and Plus 5 are decided by the casino in accordance with their study of the odds involved.

Games such as those described above, and others much more complicated, may be developed using Cube 'n Duds, but they—using the wagering system described herein—are not part of this application for patent. If other games use this system, their creators are using this idea and this patent.

I claim:

1. A method of playing a game comprising the steps of (a) providing five flat round playing pieces, each flat round playing piece having two opposite flat faces, each playing piece having a Plus (+) symbol on one flat face, and each playing piece having a Minus (–) symbol on the opposite flat face;

(b) providing a cube, the cube having an opening and a container portion for inserting and storing all five playing pieces therein;

(c) a player inserting the five playing pieces in the cube, the player shaking the cube randomly tossing the flat playing pieces in the cube, the player tossing the flat playing pieces out of the cube wherein the flat playing pieces randomly land on a playing surface;

(d) determining a score of the player by summing the "+" and "–" symbols on the playing pieces that land face up, wherein if there are more playing pieces having "+" symbols face up that player receiving a plus score, the more playing pieces having "+" symbols face up the higher the plus score, and if there are more playing pieces having "–" symbols face up that player receiving a minus score, the more playing pieces having "–" symbols face up the lower the minus score;

(e) repeating the steps (a)–(d) with another player until all players have played and the player having the higher score wins.

* * * * *